US005412888A

United States Patent [19]

Rickuss et al.

[11] Patent Number: 5,412,888

[45] Date of Patent: May 9, 1995

[54] ASSEMBLY FOR PRODUCING ARTIFICIAL SNOWFALL

[75] Inventors: Ian Rickuss, Cannock Staff's; Daniel O'Leary, Kent, both of Great Britain

[73] Assignee: Manthorpe Engineering Limited, Derbys, England

[21] Appl. No.: 162,483

[22] Filed: Dec. 3, 1993

[30] Foreign Application Priority Data

Dec. 5, 1992 [GB] United Kingdom ..... 9225468

[51] Int. Cl.[6] ..... G09F 19/00

[52] U.S. Cl. ..... 40/410; 40/409; 472/65

[58] Field of Search ..... 239/14.2, 2.2, 211, 239/289, 124, 127, 120, 121; 40/406, 407, 409, 410; 428/3, 7, 15, 18-20; 472/65

[56] References Cited

U.S. PATENT DOCUMENTS

| | | | |
|---|---|---|---|
| 901,319 | 10/1908 | Bruen | 472/65 |
| 3,147,175 | 9/1964 | Gonzalez | 472/65 X |
| 3,243,183 | 3/1966 | De Scranage | 472/65 |
| 3,415,512 | 12/1968 | Burnbaum | 239/14.2 X |
| 3,415,513 | 12/1968 | Burnbaum | 239/14.2 X |
| 3,905,140 | 9/1975 | Damiano | 40/409 |
| 4,028,830 | 6/1977 | Ottinger | 40/410 |
| 4,076,234 | 2/1978 | Burnbaum | 472/65 |
| 4,215,500 | 8/1980 | Sharp | 40/409 |
| 4,962,922 | 10/1990 | Chu | 40/410 |
| 5,200,239 | 4/1993 | Chen | 40/410 X |

FOREIGN PATENT DOCUMENTS

| | | | |
|---|---|---|---|
| 526761 | 9/1940 | United Kingdom | 40/406 |
| 701037 | 12/1953 | United Kingdom | 472/65 |
| 996697 | 6/1965 | United Kingdom . | |
| 1212456 | 11/1970 | United Kingdom . | |
| 2249858 | 5/1992 | United Kingdom . | |

*Primary Examiner*—Andres Kashnikow
*Assistant Examiner*—Lesley D. Morris
*Attorney, Agent, or Firm*—Watts, Hoffmann, Fisher & Heinke Co.

[57] ABSTRACT

An assembly for producing an artificial snowfall in a Christmas tree display arrangement is stored as a pack having a base 10 with a carrying handle 16 and a lid 18 adapted to fit over the base 10. Within the latter is an air blower unit comprising an electric motor and fan located below a cover 44, moving air from externally to a fan outlet 40 and thereafter into an air transporting tube assembly provided with a venturi, through an aperture 64 in the cover 44. A Christmas tree can locate through a central aperture 62 in the cover 44 onto a stand within the base 10. Artificial snow in the form of plastics beads is available on the cover 44 and can be moved through the venturi to the top of the tree, from where the beads fall by gravity through the tree to be collected by the cover 44 and its petal sections 52.

19 Claims, 3 Drawing Sheets

ASSEMBLY FOR PRODUCING ARTIFICIAL SNOWFALL

This invention relates to an assembly for producing artificial snowfall, and particularly artificial snowfall in relation to a display arrangement, such as a Christmas tree.

Previously proposed arrangements for creating an artificial snowfall for a Christmas tree have included relatively complex arrangements for moving artificial snowfall particles, and have often resulted in relatively complicated structures where components are located in use remote from the tree itself. This can lead to problems depending on the nature of the intended location for a tree, both from the aesthetic point of view and also the potential of accidental damage.

According to the present invention there is provided an assembly for use with a display arrangement, the assembly comprising a base part with a removable cover, air movement means having an air inlet in a wall of the base part and means for moving air from the inlet to an outlet accessible through the cover, and air transporting means connected through the cover to the air outlet, and providing for the movement thereinto of means taking the form of artificial snow, the latter being located, in use, on the cover, whereby, when the display arrangement is mounted to extend upwardly from the base part, the air transporting means can move air with the artificial snow means towards an upper end of the display arrangement and enable the artificial snow means to fall relative to the arrangement to be collected on the cover for re-distribution.

Preferably, collecting means for the artificial snow means is mounted around an internal peripheral wall or walls of the base part and is movable from a folded position, overlying the cover, to an unfolded position, lying outwardly of the base part and upwardly angled in use to collect the falling artificial snow means. The cover is preferably angled upwardly and outwardly from a central location to move the collected artificial snow means towards the latter. At the central location, there is preferably provided an aperture through which a stem of the display arrangement in the form of a tree can locate on a support stand.

Preferably also the air transporting means comprises a main tubular member, towards a lower end of which the tubular wall is partially cut and displaced inwardly to thereby reduce the cross-section of airflow at a lateral inlet to the tubular member, and create, in use, a venturi effect which induces the artificial snow means to enter the airflow. Alternatively, the air transporting means comprises a main tubular member towards a lower end of which a venturi effect is created by a further tubular member intersecting the main tubular member which induces the artificial snow means to enter the airflow. The tubular member may be formed in two parts, a first metallic part in which the venturi is formed and which is connected to the air outlet, and a second part of a plastics material connected to the free end of the metallic part. Alternatively, the venturi may be provided in a part of the main tubular member which is integrally connected to the air outlet.

The air movement means may comprise a main body part connected to a support for a fan and a drive motor therefor. The main body part and the support may each be formed of a molded plastics material. Between the fan and the air outlet may be provided an air filter.

The present invention also provides a pack for storage of an assembly to be used with a display arrangement, the pack comprising a base part, a removable cover for the base part, air movement means having an air inlet in a wall of the base part and means for moving air from the inlet to an outlet accessible through the cover, a lid removably located on the base part, and air transporting means arranged to be retained in an out-of-use condition between the lid and base part but adapted to be connected in use, with the lid removed, to the air outlet, whereby, with the base part closed by the lid, the assembly can be stored and/or transported and, when required in use, the lid can be removed, the base part can mount the display arrangement, and the air transporting means is removably connected to the air outlet for moving air with artificial snow means to an upper end of the display arrangement.

Preferably the display arrangement is a display tree, support for which can be provided below the cover, with an aperture in the cover enabling the stem of the tree to locate on the support. The air transporting means may comprise a main tubular member towards one end of which, the lower end in use, the wall is partially cut and displaced inwardly to thereby reduce the cross-section of airflow at a lateral inlet and create in use a venturi effect which induces the artificial snow means to enter the airflow. Alternatively, the air transporting means comprises a main tubular member towards a lower end of which a venturi effect is created by a further tubular member intersecting the main tubular member. The display arrangement may provide the main tubular member of the air transporting means.

Preferably also the pack includes collecting means for the artificial snow means mounted around an internal peripheral wall or walls of the base part and movable from a folded position, overlying the cover, to an unfolded position, lying outwardly of the base part and upwardly angled in use to collect the artificial snow means.

Further, the base part may be provided with a handle on a peripheral wall thereof, and the lid may be provided with an aperture through which the handle is accessible when the lid closes the pack.

The base part, the lid, the cover, and the collecting means may each be formed of cardboard.

An embodiment of the present invention will now be described by way of example only with reference to the accompanying drawings in which.

Figure 1:
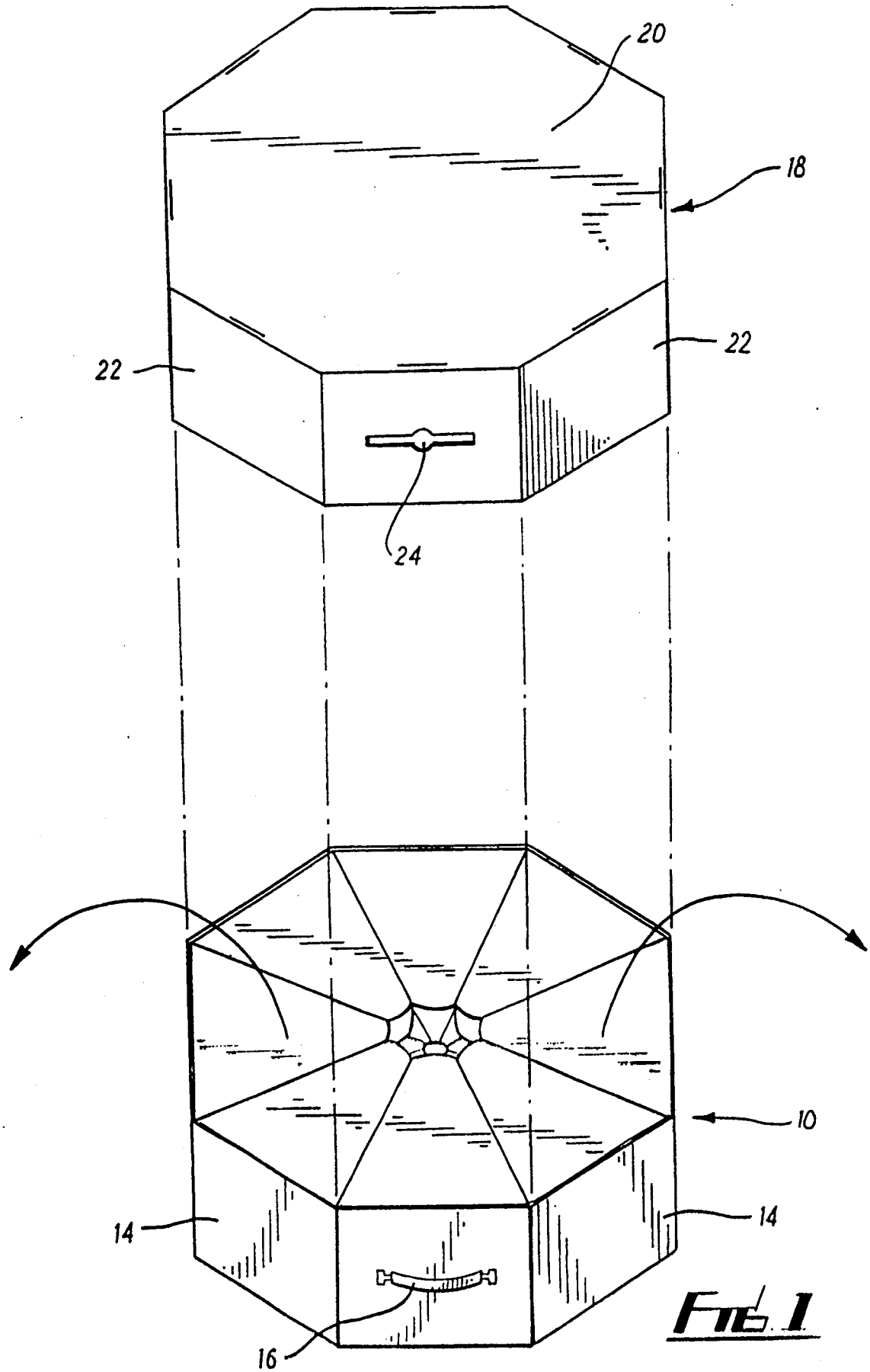
FIG. 1 is a diagrammatic view of a pack according to the present invention in a storage condition but with the lid shown removed.

A display arrangement in the form of a Christmas tree consists of an artificial tree, with a stem thereof engaging at its lower end in a support stand. To produce an artificial snowfall through the tree, it has previously been proposed to blow air through a tube extending generally alongside the stem of the tree and to provide for small particles simulating artificial snow to enter the airflow, to be ejected from the tube towards the upper end of the tree, and then to fall through the branches of the tree to be collected at the lower end of the tree for re-distribution.

Referring to the drawings, an improved assembly for producing such an artificial snowfall is stored for easy transport as a pack which includes a base 10 formed, for example, of cardboard, to have an octagonal cross-section with a bottom wall 12 and upstanding side walls 14. On one of the side walls 14 there is provided a carrying handle 16. A lid 18 formed, for example, also of cardboard has an octagonal cross-section defined by a top wall 20 and side walls 22, the lid 18 being sized whereby to fit over the base 10 with the walls 22 outwardly adjacent the walls 14, and with an opening 24 in one of the walls 22 overlying the handle 16, whereby the latter can locate through the opening 24 and be accessible for carrying of the pack.

Within the internal space of the base 10, there is provided an air blower unit having a main profiled body 26 and a profiled blower support 28, each formed preferably of a molded plastics material. The support 28 is mounted internally of the main body 26 and secured to an upper wall 30 thereof, the support 28 being profiled to provide a space between the support 28 and the upper wall 30 in which is mounted a fan 32 on a lower wall 33, an electric motor 34 for driving the fan 32 being mounted on, but positioned below, the wall 33. An opening for air to pass into the body 26 is formed in a side wall 35 thereof, and the respective profiles of the main body 26 and the support 28 are such as to provide a through path for the air from within the body 26, through an overhead passage 36 defined therein, centrally into the fan 32, the air being blown through a tangential outlet passage 38 on the support 28 to an outlet 40 in the upper wall 30 of the main body 26. The latter is located inwardly of the base part 10 to lie alongside one of the side walls 14, with the side wall opening aligning with an air vent (not shown) provided on said one side wall 14, to enable air to be drawn into the blower unit from externally of the base part 10.

A filter 42 is located between the end of the airflow passage 38 and the outlet 40. Also, electrical supply to the motor 34 can be via a cable and mains plug (not shown), which can be withdrawn through a further closable flap in said one side wall 14, for use as necessary.

The internal space of the base 10 is closed by a cover 44, preferably formed of cardboard, which has fold lines defining triangular sections 46, each of which extends from a base inwardly adjacent a respective side wall 14 to a central apex. The outer periphery of the cover 44 is provided with a downwardly extending flange 48. The triangular sections 46 slope downwardly to the center of the cover 44 for a purposes hereinafter described.

Figure 2:
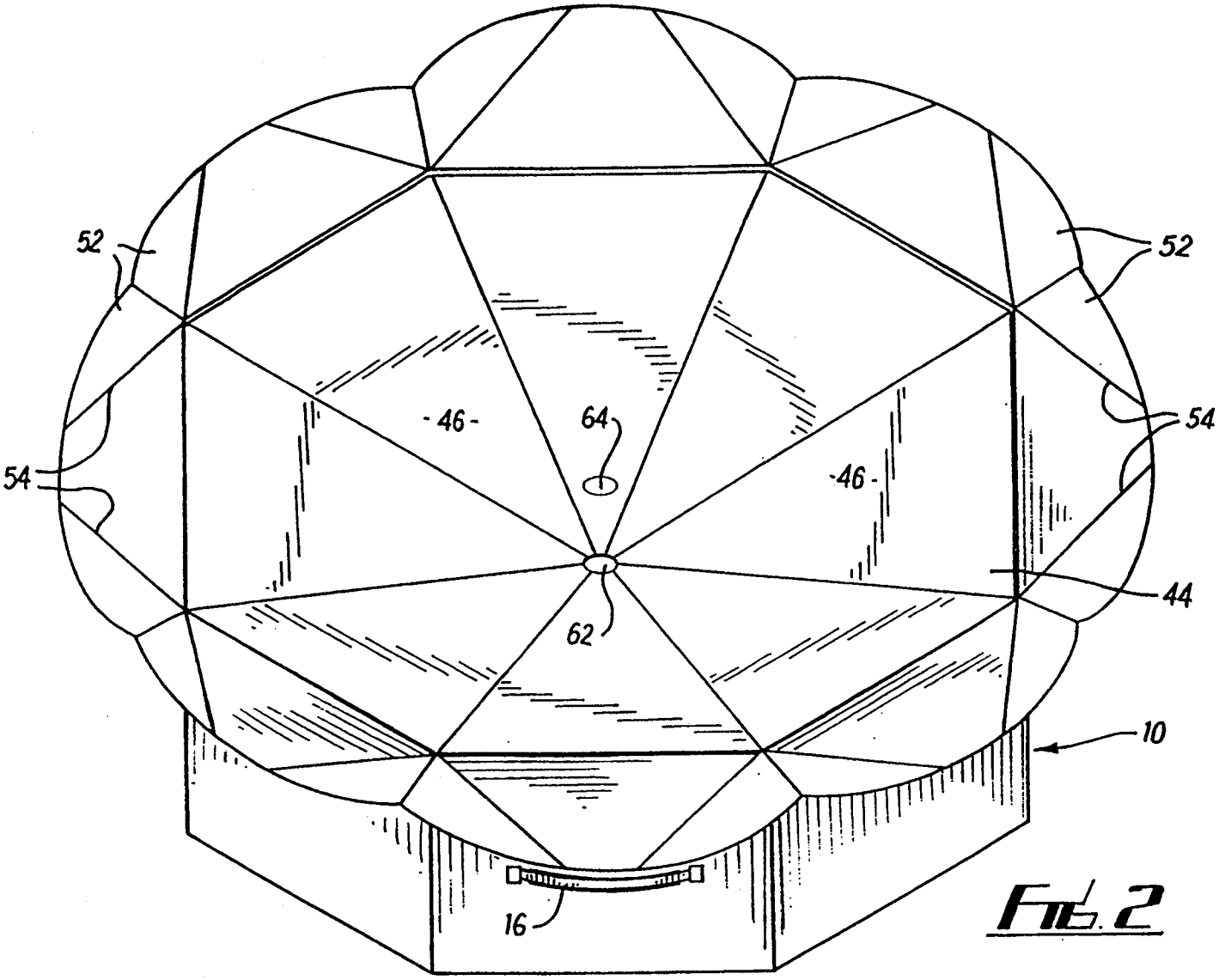
FIG. 2 is a diagrammatic perspective view omitting the lid but showing a base part of the pack in an in-use position.

To assist in collecting the artificial snow falling through the tree, a collector, preferably formed of cardboard, is secured inwardly of the side walls 14 towards the upper edges thereof, by means of a flange 50 of octagonal cross-section. On each flange section is integrally formed a section 52 provided with fold lines 54 which enable the sections 52, integrally formed together, to fold inwardly over the cover 44, as shown in FIG. 1 when the assembly is not in use, but to extend outwardly and upwardly relative to the base 10 in the form of a petals when the assembly is in use, as shown in FIG. 2. The cover 44 is dimensioned so that the flange 48 thereof is a close fit internally of the flange 50, to thereby retain the cover 44 in position over the blower unit but enable the cover 44 to be removed when necessary.

Figure 3:
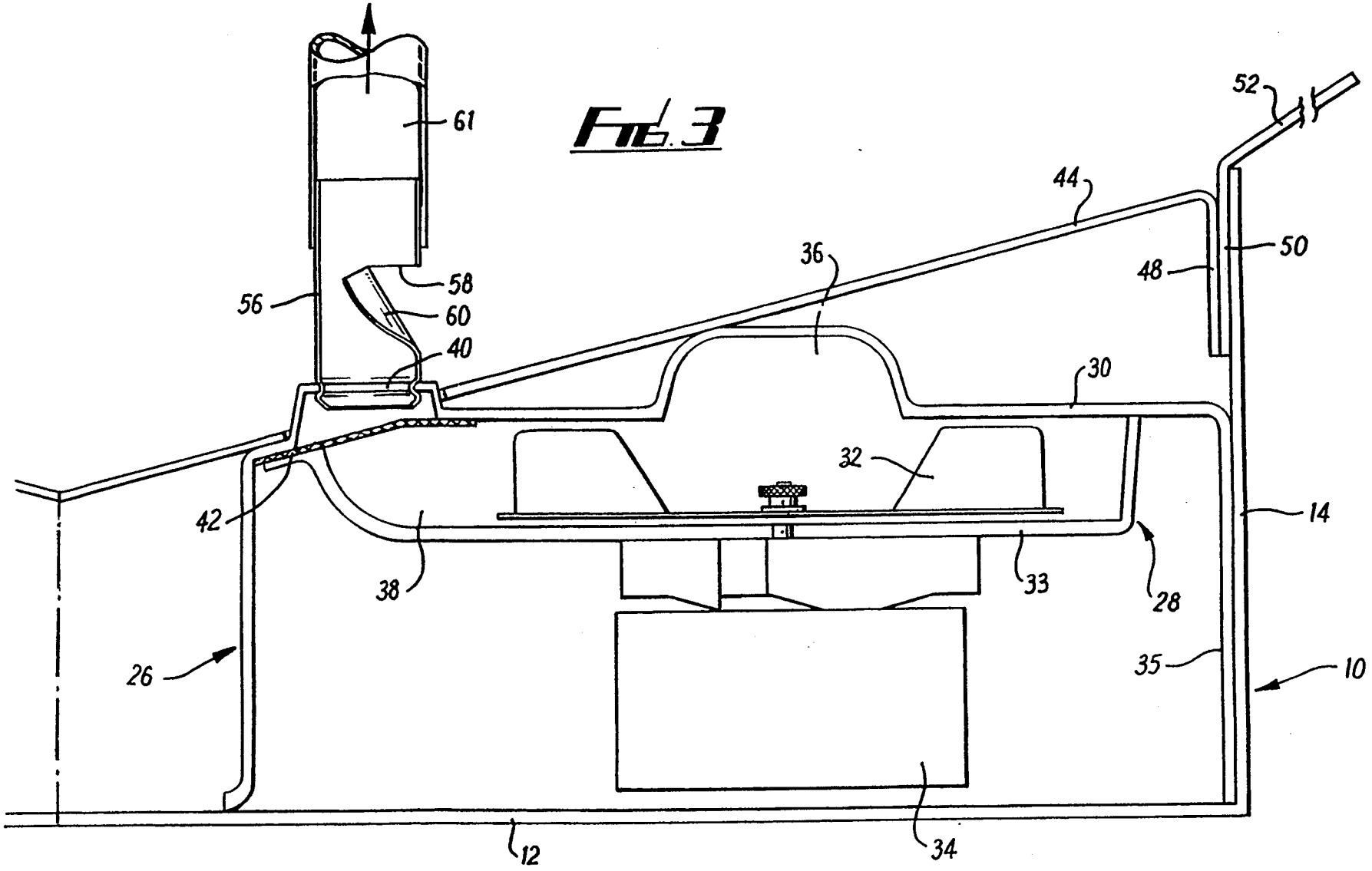
FIG. 3 is a section through part of the assembly of the invention in an in-use condition.

Within the pack, and stored when not in use beneath the cover 44 there is also provided a supply of polymer beads for creating the artificial snowfall. Also, stored within the pack when not in use, there is provided a tube assembly for transporting air from the outlet 40 towards the upper end of the Christmas tree. The tube assembly, as shown in FIG. 3, comprises a first tube 56, preferably formed of metal, profiled at one end to provide an annular recess in which can locate the edge of the aperture defining the outlet 40 so as to retain the tube 56 upwardly extending. A part of the wall of the tube 56 has a lateral cut 58 whereby to enable a part 60 of the tube wall to be displaced inwardly and thereby reduce the cross-sectional area of the tube at the location of the cut 58. The arrangement thereby also provides a lateral inlet to the tube 56 at the cut 58. In use, when air is blown through the outlet 40 into the tube 56, a venturi effect is created to thereby induce an airflow into the tube 56 at the inlet defined by the cut 58. As the tube 56 in use would normally be within the depth of beads supported on the cover 44, the venturi draws beads into the tube 56. A further tube 61, formed for example of a plastics material, is fitted over the upper end of the tube 56 to extend towards the upper end of the tree and thereby enables the beads to be transported to the upper end of the tree. The beads then exit from the upper end of the tube 61 and fall by gravity through the branches of the tree to be collected by the petal sections 52 and the cover 44 for re-distribution.

An additional tube may be provided on the upper end of the tube 61, and may have a shaped outlet to provide for variation in the exit pattern of the beads. The use of such an additional tube also accommodates different heights of tree.

When required to be used, the lid 18 is removed from the base 10, and the petal sections 52 are then unfolded to the position shown in FIG. 2. The cover 44 can then be removed to gain access to the beads and the tube assembly. With the cover 44 removed, the user can then locate a support stand for the Christmas tree on the bottom wall 12 before the cover 44 is replaced. A central aperture 62 in the cover 44 enables the stem of the Christmas tree to locate therethrough into the support stand. A seal (not shown) may be provided for the central aperture 62 to accommodate trees with different stem diameters. The tube 56 is located through another aperture 64 in the cover 44 into the air outlet 40, and the tube 61 can be tied to the tree stem, for example by plastics ties. The beads are emptied on to the cover 44, and a power supply is made available to the motor 34, whereafter the assembly is ready for use.

There is therefore provided an assembly for creating an artificial snowfall for a Christmas tree which is simple and inexpensive to produce, but which can be made available in a very compact and secure pack easy to store and transport, and very lightweight. Most of the pack is itself used in the display, thereby avoiding additional materials and therefore expense involved in providing a pack which is only used for storage and transport. The pack is easy to convert into the assembly for use and provides an aesthetically pleasing arrangement.

Various modifications may be made without departing from the invention. For example, the tube 56 may create the venturi by being intersected by a further tube. Also, the tube 56 may be formed integrally with the body 26, for example by injection molding. In a further alternative, the stem of the tree may be hollow and may form itself the tube assembly through which the beads are transported to the upper end of the tree, with an appropriate venturi arrangement provided towards the lower end. Also, the shape and configuration of the components as described may differ, and the components may be made of different materials if required.

We claim:

1. For use with a display arrangement, an assembly comprising a base part with a removable cover, air movement means disposed in the base part and having an air inlet in a wall of the base part and means for moving air from the inlet to an air outlet accessible through the cover, and air transporting means connected through the cover to the air outlet, and providing for the movement thereinto of means taking the form of artificial snow, collecting means for the artificial snow means being mounted around an internal peripheral wall or walls of the base part to provide an extension of the cover, and being movable from a folded position, overlying the cover, to an unfolded position, lying outwardly of the base part and upwardly angled in use, the artificial snow means being located, in use, on the cover, whereby, when the air transporting means extends upwardly from the base part, the air transporting means can move air with the artificial snow means upwardly to a location remote from the air outlet and enable the artificial snow means to fall under gravity to be collected on the cover for re-distribution.

2. An assembly according to claim 1, wherein the cover is angled upwardly and outwardly from a central location to move the collected artificial snow means towards the latter.

3. An assembly according to claim 2, wherein, at the central location, there is provided an aperture through which a stem of such display arrangement in the form of a tree can locate on a support stand.

4. An assembly according to claim 1, wherein the air transporting means comprises a main tubular member including a tubular fall, the tubular wall being partially cut near its lower end and displaced inwardly to thereby reduce the cross-section of airflow at a lateral inlet to the tubular member, and create, in use, a venturi effect which induces the artificial snow means to enter the airflow.

5. An assembly according to claim 4, wherein the main tubular member is formed in two parts, a first metallic part in which the partial cut is formed and which is connected to the air outlet, and a second part of a plastics material connected to the free end of the metallic part.

6. An assembly according to claim 4, wherein the venturi is provided in a part of the main tubular member which is integrally connected to the air outlet.

7. An assembly according to claim 1, wherein the air transporting means comprises a main tubular member formed in two parts, a first metallic part in which a venturi is formed and which is connected to the air outlet, and a second part of a plastics material connected to the free end of the metallic part.

8. An assembly according to claim 5, wherein the metallic part of the main tubular member is integrally connected to the air outlet.

9. An assembly according to claim 1, wherein the air movement means comprises a main body part connected to a support for a fan and a drive motor therefor.

10. An assembly according to claim 9, wherein the main body part and the support are each formed of a molded plastics material.

11. An assembly according to claim 9, wherein an air filter is provided between the fan and the air outlet.

12. For use with a display arrangement, a pack for storage of an assembly, the pack comprising a base part, a removable cover for the base part, air movement means having an air inlet in a wall of the base part and means for moving air from the inlet to an outlet accessible through the cover, a lid removably located on the base part, and air transporting means arranged to be retained in an out-of-use condition between the lid and base part but adapted to be connected in use, with the lid removed to the air outlet, whereby, with the base part closed by the lid, the assembly can be stored and/or transported and, when required in use, the lid is removed from the base part, and the air transporting means is removably connected to the air outlet for moving air with artificial snow means to a location remote from the air outlet.

13. A pack according to claim 12, to be used with a display arrangement in the form of a display tree support for which is provided below the cover, with an aperture in the cover enabling a stem of the tree to locate on the support.

14. A pack according to claim 12, wherein the air transporting means comprises a main tubular member towards one end of which, the lower end in use, the wall is partially cut and displaced inwardly to thereby reduce the cross-section of airflow at a lateral inlet and create in use a venturi effect which induces the artificial snow means to enter the airflow.

15. A pack according to claim 12, wherein the display arrangement provides the air transporting means.

16. A pack according to claim 12, including collecting means for the artificial snow means mounted around an internal peripheral wall or walls of the base part and movable from a folded position, overlying the cover, to an unfolded position, lying outwardly of the base part and upwardly angled in use to collect the artificial snow means.

17. A pack according to claim 16, wherein the base part, the lid, the cover, and the collecting means are each formed of cardboard.

18. A pack according to claim 12, wherein the base part is provided with a handle on a peripheral wall thereof.

19. A pack according to claim 18, wherein the lid is provided with an aperture through which the handle is accessible when the lid closes the pack.

* * * * *